US006769576B2

(12) United States Patent
Ichikawa

(10) Patent No.: US 6,769,576 B2
(45) Date of Patent: Aug. 3, 2004

(54) DELIVERY CONTAINER

(75) Inventor: Kazuhiro Ichikawa, Tokyo (JP)

(73) Assignee: Kabushiki Kaisha Top, Tokyo (JP)

( * ) Notice: Subject to any disclaimer, the term of this patent is extended or adjusted under 35 U.S.C. 154(b) by 0 days.

(21) Appl. No.: 10/275,403

(22) PCT Filed: Jun. 4, 2001

(86) PCT No.: PCT/JP01/04694

§ 371 (c)(1),
(2), (4) Date: Nov. 5, 2002

(87) PCT Pub. No.: WO02/00524

PCT Pub. Date: Jan. 3, 2002

(65) Prior Publication Data

US 2003/0121940 A1 Jul. 3, 2003

(30) Foreign Application Priority Data

Jun. 26, 2000 (JP) ..... 2000-191542

(51) Int. Cl.[7] ..... B65D 88/54

(52) U.S. Cl. ..... 222/321.5; 222/321.9; 222/321.6

(58) Field of Search ..... 222/321.1, 321.5, 222/321.6, 321.7, 321.9, 372, 377, 378, 383.1, 385

(56) References Cited

U.S. PATENT DOCUMENTS

| | | | | | |
|---|---|---|---|---|---|
| 625,384 | A | * | 5/1899 | Dewhurst et al. | 222/321.5 |
| 697,700 | A | * | 4/1902 | Alden | 222/321.9 |
| 923,447 | A | * | 6/1909 | Schmidt | 222/321.9 |
| 987,970 | A | * | 3/1911 | Earl | 222/321.5 |
| 1,783,419 | A | * | 12/1930 | Fitch | 222/321.5 |
| 1,810,135 | A | * | 6/1931 | Fitch | 222/321.5 |
| 1,986,248 | A | * | 1/1935 | Bowlzer | 222/321.5 |
| 1,986,250 | A | * | 1/1935 | Cole | 222/321.5 |
| 2,378,624 | A | * | 6/1945 | Edwards | 222/321.5 |
| 2,495,551 | A | * | 1/1950 | Sakowski | 222/182 |
| 4,728,008 | A | * | 3/1988 | Graf et al. | 222/321.5 |
| 5,366,120 | A | * | 11/1994 | Tollasepp | 222/385 |
| 5,437,397 | A | * | 8/1995 | Fuchs | 222/321.9 |

FOREIGN PATENT DOCUMENTS

| | | | |
|---|---|---|---|
| JP | 59-3883 | U | 1/1984 |
| JP | 60-65267 | U | 5/1985 |
| JP | 3-72683 | U | 7/1991 |
| JP | 05-319466 | A | 12/1993 |

* cited by examiner

*Primary Examiner*—Kenneth Bomberg
(74) *Attorney, Agent, or Firm*—Birch, Stewart, Kolasch & Birch, LLP

(57) ABSTRACT

A delivery container has a casing filled with a chemical liquid and a cap mounted on an upper end of the casing. A hollow cylinder having slots is disposed in and integrally formed with a lower portion of the casing. A tubular piston with a check valve is slidably disposed in the cylinder. The piston is connected to the cap, which has a discharge port, by a hollow shaft which extends vertically through an upper portion of the casing, so that vertical movement of the cap can be transmitted via the shaft to the piston. Inasmuch as the cylinder is disposed in the bottom of the casing, the cylinder is filled at all times with the chemical liquid which is supplied via the slots by gravity. The chemical liquid does not need to be drawn upwardly, and can be discharged in a constant quantity from the discharge port in one cycle of operation of the delivery container.

5 Claims, 2 Drawing Sheets

DELIVERY CONTAINER

This application is the national phase under 35 U.S.C. §371 of PCT International Application No. PCT/JP01/04694 which has an International filing date of Jun. 4, 2001, which designated the United States of America.

TECHNICAL FIELD

The present invention relates to a delivery container for storing a liquid such as a chemical liquid, a gel-like flowable liquid, or the like and discharging the liquid based on a pumping action.

BACKGROUND ART

One known a delivery container for discharging a liquid such as a chemical liquid, a gel-like flowable liquid, or the like is disclosed in Japanese laid-open patent publication No. 5-319466. The disclosed conventional delivery container has a pump disposed in an upper portion thereof for drawing up a liquid from within a chamber in the container. The liquid in the container is drawn via a tube extending downwardly from the pump and discharged from a discharge port positioned above the pump.

The disclosed delivery container has check balls disposed as check valves upwardly and downwardly of the pump. When the pump is pushed, a piston in the pump is displaced downwardly to push the liquid filled in the pump. The lower check ball closes its port and the upper check ball opens its port, allowing the liquid to be discharged from the pump out of the discharge port. When the pump is released of the push, the piston is displaced upwardly under the bias of a spring. The upper check ball closes its port and the lower check ball opens its port, filling the pump with the liquid supplied from the chamber in the container.

The conventional delivery container is relatively complex in structure because of the plural check valves employed for discharging the liquid from the container. For discharging the liquid from the container, the container needs to perform two different actions, i.e., an action to draw the liquid from the chamber into the pump and an action to discharge the liquid from the pump. In each of these actions, the check valves have to operate normally to perform their intended functions. Accordingly, the pump is required to be machined and assembled with high accuracy, and hence is difficult to manufacture. Because the check valves of the conventional delivery container are of a complex construction, the amount of the liquid that is charged in one cycle from the container tends to vary if the check valves suffer a slight error in their operation.

It is necessary to prevent a negative pressure from being developed in the interior of the container because such a negative pressure would make it difficult for the pump to draw in the liquid from the chamber based on a pumping action. The solution employed in the delivery container disclosed in Japanese laid-open patent publication No. 5-319466 is a free piston that slides downwardly in the container as the amount of liquid in the container is reduced, thus preventing a negative pressure from being developed in the container. The free piston and ancillary members make the container structurally complex. Another possible approach to preventing a negative pressure from being developed in the container would be to introduce external air into the container. However, the external air thus introduced would possibly allow microorganisms to find their way into the container, contaminating the liquid in the container.

It is an object of the present invention to provide a delivery container which is of a relatively simple structure and is capable of discharging a metered amount of liquid reliable in each cycle of operation.

DISCLOSURE OF THE INVENTION

To achieve the above object, there is provided in accordance with the present invention a delivery container having a bottomed cylindrical casing for storing a liquid therein, and a cap vertically movably mounted on an upper end of the casing and having a discharge port for discharging the liquid from the casing, the cap being normally biased to move upwardly away from the casing by a spring and movable downwardly toward the casing for discharging the liquid from the casing through the discharge port. The delivery container also has a cylinder disposed in a lower portion of the casing and having an axis extending vertically, a piston vertically slidably disposed in the cylinder and having a communication hole vertically extending therethrough, a hollow shaft having an end connected to the communication hole of the piston and an opposite end connected to the discharge port of the cap, and a check valve disposed in a passage extending from the communication hole via the shaft to the discharge port, for passing the liquid flowing from below the piston and blocking the liquid flowing from above the piston, the cylinder having a flow passageway for providing fluid communication between the interior of the cylinder and the interior of the casing when the piston is positioned upwardly in the cylinder, and blocking fluid communication between the interior of the piston and the interior of the casing when the piston is positioned downwardly in the cylinder.

With the delivery container thus constructed, the cylinder is mounted in the lower portion of the casing, and the flow passageway provides fluid communication between the interior of the piston and the interior of the casing when the piston is positioned downwardly in the cylinder. Therefore, the cylinder is filled with the liquid by gravity from the flow passageway. It is thus not necessary for the cylinder to draw up the liquid as is the case with the conventional delivery container.

When the piston is pushed downwardly, the piston closes the flow passageway, and the liquid in the cylinder flows through the communication hole of the piston, the check valve, and the shaft, and is discharged from the discharge port. Since the piston closes the flow passageway when the liquid is discharged, any other valve mechanisms such as check balls are not required, and hence the mechanism for discharging the liquid is simplified. Because the cylinder is filled with the liquid by gravity at all times, the quantity of the liquid that is discharged is determined by the distance that the piston moves after the piston has closed the flow passageway. As the quantity of the liquid that is discharged from the delivery container is not governed by how good or bad the operation of a conventional valve mechanism is, the quantity of the liquid that is discharged from the delivery container is maintained at a constant level.

When the piston is pushed upwardly under the bias of the spring, the check valve prevents the liquid pushed out of the cylinder from flowing back into the cylinder. The check valve may be simplified in structure as it does not affect the amount of the liquid that is discharged.

If the casing is of a sealed structure, then a negative pressure is developed in the casing when the liquid is discharged from the discharge port. Nevertheless, the liquid can reliably be discharged because the cylinder is filled with the liquid by gravity. The delivery container according to the present invention is of a relatively simple structure as it does not have a free piston slidable in the casing, unlike the conventional delivery container. The sealed casing is protected against the entry of microorganisms into the liquid held in the casing.

The flow passageway preferably comprises a slot defined in the cylinder and extending downwardly from an upper portion of the cylinder across the range in which the piston is slidable, for providing fluid communication between the interior of the cylinder and the interior of the casing, whereby the liquid can be discharged in a quantity determined by the length of the slot. When the piston is depressed over the slot in the cylinder, the liquid flows back from the cylinder into the casing, and is not discharged from the discharge port. When the piston is depressed past the slot in the cylinder, the liquid is discharged from the discharge port. Therefore, if the slot is shorter, the amount of the liquid pushed out by the piston is larger, and if the slot is longer, the amount of the liquid pushed out by the piston is smaller. Since the amount of the liquid discharged from the delivery container can easily be adjusted by the length of the slot, it is easy to change the discharged amount of the liquid depending on the application of the delivery container.

Preferably, the piston and the shaft are integrally coupled substantially linearly to each other, the shaft having a portion projecting upwardly from the casing with the piston mounted in the cylinder. Because the cylinder is positioned in the lower portion of the casing, it would be difficult to install the piston alone in the cylinder. However, as the piston and the shaft are integrally coupled substantially linearly to each other and the shaft has a portion projecting upwardly from the casing with the piston mounted in the cylinder, the piston can be installed in the cylinder by holding the shaft. Thus, it is easy to carry out the process of installing the piston in the cylinder.

The casing preferably has a first tube surrounding the projecting portion of the shaft and extending vertically toward the cap, and the cap having a second tube extending vertically toward the casing and held in slidably fitting relationship to the first tube, the first tube having a first engaging lip projecting from a distal end thereof laterally toward the second tube, and the second tube having a second engaging lip projecting from a distal end thereof laterally toward the first tube, the arrangement being such that when the cap is positioned upwardly, the first engaging lip and the second engaging lip engage each other to retain the cap on the casing.

Since the first tube and the second tube are held in slidably fitting engagement with each other, no dust and dirt enters from the exterior into the space that is surrounded by the first tube and the second tube. In addition, because the portion of the shaft that projects from the casing is positioned in the space surrounded by the first tube and the second tube, no dust and dirt enters the casing upon sliding movement of the shaft relative to the casing when the shaft is vertically moved in response to vertical movement of the cap.

BRIEF DESCRIPTION OF THE DRAWINGS

FIG. 1(*b*) is a cross-sectional view of the delivery container, showing the position of the parts when the cap is pushed down;

FIG. 3(*b*) is a perspective view of the check valve with its valve port being closed.

BEST MODE FOR CARRYING OUT THE INVENTION

Embodiments of the present invention will be described below with reference to FIGS. 1 through 3.

Figure 1A:
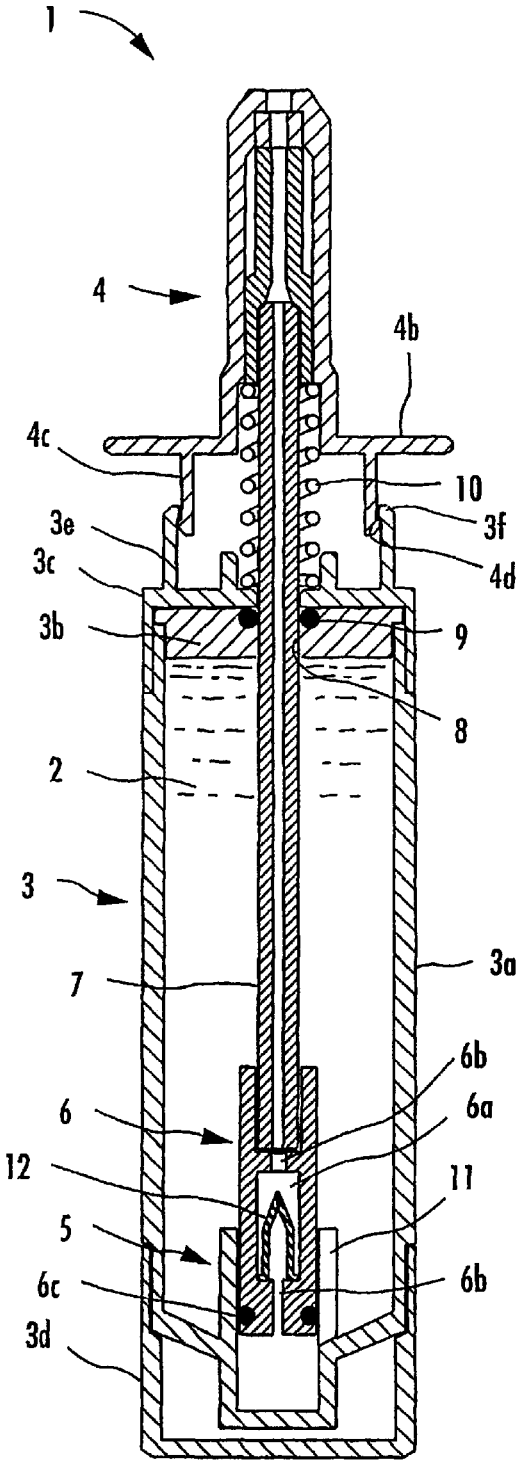
FIG. 1(*a*) is a cross-sectional view of a delivery container according to the present invention, showing the position of the parts when a cap is not pushed down.
Figure 1B:
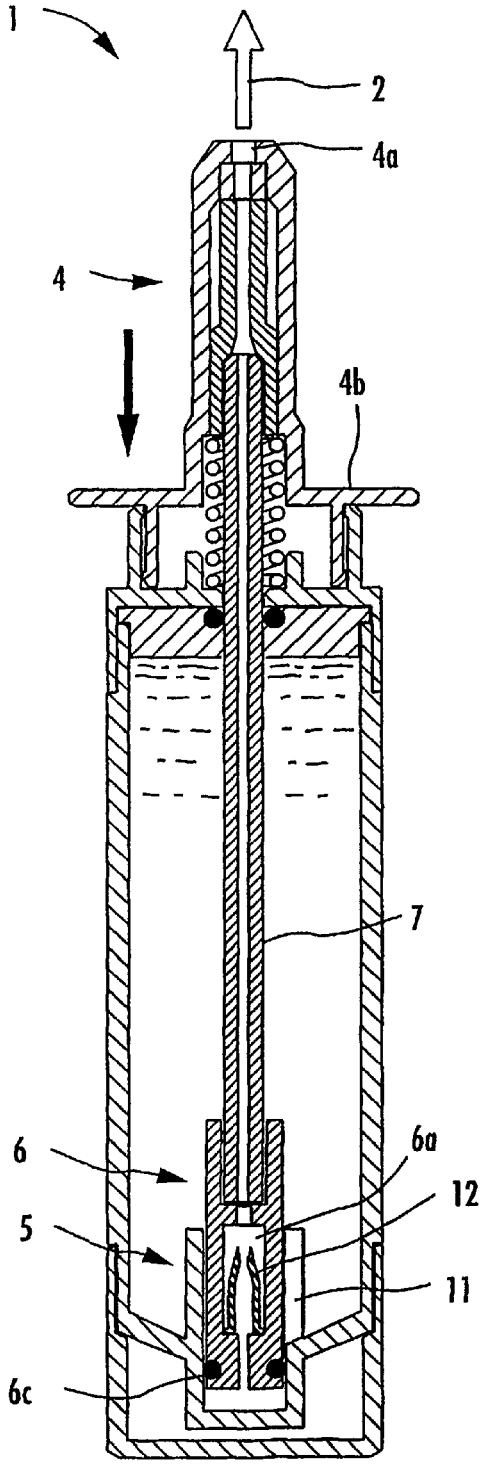

As shown in FIGS. 1(*a*) and 1(*b*), a delivery container 1 according to the present invention comprises a casing 3 filled with a chemical liquid 2 and a cap 4 mounted on an upper end of the casing 3. A hollow cylinder 5 whose axis extends vertically is disposed in and integrally formed with a lower portion of the casing 3, and a tubular piston 6 is slidably disposed in the cylinder 5. The piston 6 is connected to the cap 4 by a hollow shaft 7 which extends vertically through an upper portion of the casing 3, so that vertical movement of the cap 4 can be transmitted via the shaft 7 to the piston 6. The cap 4, the shaft 7, and the piston 6 are integrally coupled substantially linearly to each other. The shaft 7 has an upper end portion projecting axially from the casing 3.

The casing 3 comprises a substantially cylindrical barrel 3*a* with the cylinder 5 integrally formed therewith at its bottom, a middle lid 3*b* closing an upper end of the barrel 3*a*, an upper lid 3*c* fixed to the upper end of the barrel 3*a* in covering relation to the middle lid 3*b*, and a bottom lid 3*d* fixed to a lower end of the barrel 3*a* in covering relation to the bottom thereof. The middle lid 3*b* and the upper lid 3*c* have a communication hole 8 defined centrally therein, through which the shaft 7 slidably extends, with an O-ring 9 being interposed between sliding surfaces of the middle lid 3*b* and the shaft 7 for preventing external air from entering the casing 3. The interior of the casing 3 is thus sealed against contact with external air. An upwardly projecting cylindrical outer tube (first tube) 3*e* is mounted on an upper surface of the upper lid 3*c*.

The cap 4 has a substantially cylindrical upper portion with a discharge port 4*a* defined in its tip end, and a flange 4*b* disposed on its lower portion for the user to engage with fingers to push the cap 4 downwardly. The cap 4 is normally biased to move upwardly by a spring 10 housed therein. The flange 4*b* has on its lower surface a downwardly projecting cylindrical inner tube (second tube) 4*c* slidably fitted in the outer tube 3*e* on the upper lid 3. The inner tube 4*c* has an annular outwardly projecting engaging lip 4*d* on the lower end of the outer circumferential surface thereof, and the outer tube 3*e* has an annular inwardly projecting engaging lip 3*f* on the upper end of the inner circumferential surface thereof. These engaging lips 4*d*, 3*f* can engage each other for retaining the cap 4 on the casing 3 against removal therefrom. Though the cap 4 is normally biased to move upwardly under the bias of the spring 10, the cap 4 is prevented from being dislodged from the upper lid 4*c* because the outer tube 3*e* and the inner tube 4*c* are held together by the engaging lips 3*f*, 4*d*. The upper end portion of the shaft 7 which projects from the casing 3 is disposed in a space that is surrounded by the outer tube 3*e* and the inner tube 4*c*. The spring 10 is also disposed in this space.

Figure 2:
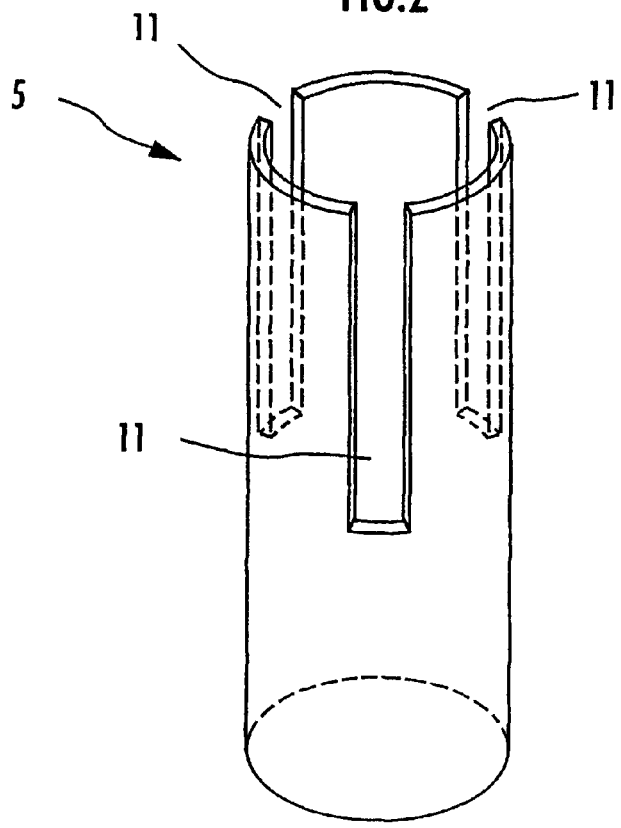
FIG. 2 is a perspective view of a cylinder in the delivery container shown in FIGS. 1(*a*) and 1(*b*)
Figure 3A:
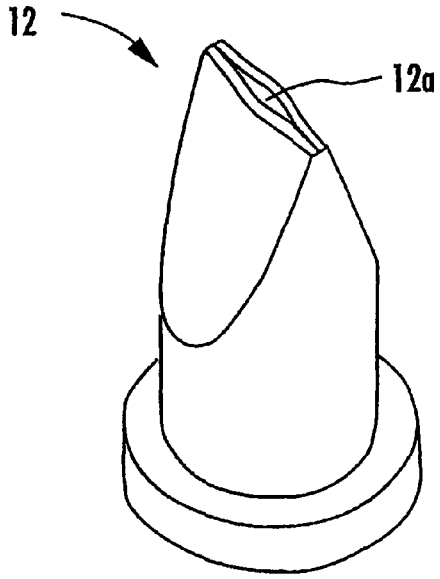
FIG. 3(*a*) is a perspective view of a check valve with its valve port being open.
Figure 3B:
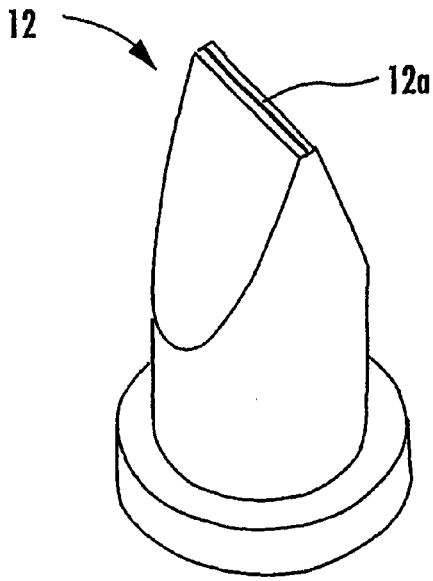

As shown in FIG. 2, the cylinder 5 is of a substantially hollow cylindrical shape and has three slots 11 defined therein at angularly equally spaced intervals and extending axially downwardly from the upper end of the cylinder 5. The slots 11 axially extend to a position above the range in which the piston 6 is slidable. As shown in FIG. 1(*a*), when the piston 6 is positioned upwardly, the interior of the cylinder 5 and the interior of the casing 3 communicate with each other via the slots 11. Therefore, when the piston 6 is positioned upwardly, the cylinder 5 is filled at all times with the chemical liquid 2 that is supplied from the casing 3 via the slots 11 by gravity.

The piston 6 is slidably disposed in the cylinder 5 and is of a substantially hollow cylindrical shape. The piston 6 has a cylindrical valve chamber 6*a* defined substantially centrally therein with a check valve 12 disposed in the valve chamber 6*a*. The piston 6 also has a communication hole 6*b* defined axially therein which extends from the upper end of the piston 6 through the valve chamber 6*a* to the lower end of the piston 6. An O-ring 6*c* is mounted in the outer circumferential surface of the lower end of the piston 6 and held against the inner circumferential surface of the cylinder 5.

The check valve 12 is made of silicone rubber. As shown in FIGS. 3(*a*) and 3(*b*), the check valve 12 has a lower portion in the shape of a hollow cylinder and an upper portion in the shape of a wedge tapered toward its upper tip end. The upper tip end of the wedge-shaped upper portion of the check valve 12 has a straight slit as a valve port 12*a* defined therein for providing fluid communication between the exterior and interior of the check valve 12. When the chemical liquid 2 flows into the check valve 12 from below the piston 6, the valve port 12*a* is opened to allow the chemical liquid 2 to pass therethrough, as shown in FIG. 3(*a*). When the chemical liquid 2 flows toward the check valve 12 from above the piston 6, the valve port 12*a* is closed to prevent the chemical liquid 2 from passing therethrough, as shown in FIG. 3(*b*).

The hollow shaft 7 has its upper end coupled to the cap 4 and its lower end coupled to the piston 6. The shaft 7 provides fluid communication between the communication hole 6*b* defined in the piston 6 and the discharge port 4*a* defined in the cap 4.

Operation of the delivery container 1 for discharging the chemical liquid 2 will be described in detail below. When the cap 4 is not pressed downwardly, as shown in FIG. 1(*a*), the cap 4 is biased upwardly by the spring 10, and the piston 6 connected to the cap 4 by the shaft 7 is positioned upwardly. At this time, the interior of the cylinder 5 and the interior of the casing 3 communicate with each other through the slots 11, allowing the cylinder to be filled with the chemical liquid 2 by gravity.

When the user of the delivery container 1 grips the flange 4*b* and presses the cap 4 downwardly, as shown in FIG. 1(*b*), the piston 6 is displaced downwardly by the shaft 7 that is coupled to the cap 4. Until the O-ring 6*c* on the piston 6 reaches the lower ends of the slots 11, the chemical liquid 5 in the cylinder 5 flows back into the casing 3 by being pushed by the piston 6, and hence is not discharged from the discharge port 4*a*. When the O-ring 6*c* moves downwardly past the lower ends of the slots 11, the chemical liquid 5 in the cylinder 5 is pressed by the piston 6. The chemical liquid 5 pressed by the piston 6 flows upwardly through the communication hole 6*b* into the valve chamber 6*a* where the chemical liquid 5 enters the valve chamber 12. Since the valve port 12*a* is opened when the chemical liquid 2 flows upwardly into the valve chamber 12 from below the piston 6, as shown in FIG. 3(*a*), the chemical liquid 2 flows through the piston 6 and then the shaft 7, and is discharged from the discharge port 4*a*.

When the user then releases the flange 4*b*, the cap 4 is pushed back upwardly under the resiliency of the spring 10, causing the shaft 7 coupled to the cap 4 to push back the piston 6 upwardly. At this time, the chemical liquid 2 remaining in the upper portion of the piston 6, the shaft 7, and the cap 4 tends to flow back toward the cylinder 5. However, because the valve port 12*a* of the check valve 12 is closed, the remaining chemical liquid 2 does not flow back into the cylinder 5. When the O-ring 6*c* moves upwardly past the lower ends of the slots 11, the chemical liquid 2 in the casing 3 flows through the slots 11 into the cylinder 5, which is filled with the chemical liquid 5.

With the delivery container 1 thus constructed, since the cylinder 5 is mounted in the bottom of the casing 3, it is not necessary for the cylinder 5 to draw up the chemical liquid 2 as is the case with the conventional delivery container. Therefore, the structure of the delivery container 1 for discharging the chemical liquid 2 is relatively simple and hence can easily be manufactured. Inasmuch as the cylinder 5 is filled with the chemical liquid 2 by gravity at all times, the delivery container 1 is capable of reliably discharging the chemical liquid 2 even through the casing 3 is of a sealed structure.

The amount of the liquid 2 which is discharged in one cycle is determined by the axial length of the slots 11 defined in the cylinder 5. Therefore, the delivery container 1 can discharge the chemical liquid 2 in a constant quantity at all times when the piston 6 moves from the lower ends of the slots 11 to the lowermost end of its stroke. The delivery container 1 may be required to discharge different liquids in different quantities depending on the natures of the liquids. For example, the delivery container 1 is required to discharge the chemical liquid 2 in a relatively small quantity, and is required to discharge a cosmetic in a relatively large quantity. The delivery container 1 can easily change the amount of the liquid to be discharged therefrom in one cycle by adjusting the lengths of the slots 11 in the cylinder 5, i.e., selecting one of a plurality of cylinders 5 having slots 11 of different lengths. Consequently, the delivery container 1 lends itself to many different applications.

In the above embodiment, the check valve 12 is housed in the piston 6. However, the check valve 12 may be housed in the shaft 7 or the cap 4. While the slots 11 are defined as a passageway that provides fluid communication between the interior of the cylinder 5 and the interior of the casing 3 in the above embodiment, communication holes may instead be defined as such as a flow passage in the side wall of the cylinder 5.

INDUSTRIAL APPLICABILITY

As described above, the present invention is applicable to a delivery container for storing a liquid such as a medical fluid, gel-like flowable fluid, or the like and discharging the liquid based on a pumping action.

What is claimed is:

1. A delivery container comprising:

a bottomed cylindrical casing for storing a liquid therein;

a cap vertically movably mounted on an upper end of said casing and having a discharge port for discharging the liquid from said casing, said cap being normally biased to move upwardly away from said casing by a spring and movable downwardly toward said casing for discharging the liquid from said casing through said discharge port;

a cylinder disposed in a lower portion of said casing and having an axis extending vertically;

a piston vertically slidably disposed in said cylinder and having a communication hole vertically extending therethrough;

a hollow shaft having an end connected to the communication hole of said piston and an opposite end connected to the discharge port of said cap; and a check valve disposed inside a valve chamber of said piston in a passage extending from said communication hole via said shaft to said discharge port, for passing the liquid flowing from below said piston and blocking the liquid flowing from above said piston;

said cylinder having a flow passageway for providing fluid communication between the interior of said cylinder and the interior of said casing when said piston is positioned upwardly in said cylinder, and blocking fluid communication between the interior of said piston and the interior of said casing when said piston is positioned downwardly in said cylinder.

2. The delivery container according to claim 1, wherein said flow passageway comprises a slot defined in said cylinder and extending downwardly from an upper portion of said cylinder across the range in which said piston is slidable, for providing fluid communication between the interior of said cylinder and the interior of said casing, whereby the liquid can be discharged in a quantity determined by the length of said slot.

3. The delivery container according to claim 1, wherein said piston and said shaft are integrally coupled substantially linearly to each other, said shaft having a portion projecting upwardly from said casing with said piston mounted in said cylinder.

4. The delivery container according to claim 3, wherein said casing has a first tube surrounding the projecting portion of said shaft and extending vertically toward said cap, and said cap having a second tube extending vertically toward said casing and held in slidably fitting relationship to said first tube, said first tube having a first engaging lip projecting from a distal end thereof laterally toward said second tube, and said second tube having a second engaging lip projecting from a distal end thereof laterally toward said first tube, the arrangement being such that when said cap is positioned upwardly, said first engaging lip and said second engaging lip engage each other to retain said cap on said casing.

5. The delivery container according to claim 1, wherein said check valve is made of silicone rubber.

* * * * *